US005992988A

United States Patent [19]

Haigo

[11] Patent Number: 5,992,988

[45] Date of Patent: Nov. 30, 1999

[54] INK CARTRIDGE HAVING AN ATMOSPHERE COMMUNICATING CHANNEL OF LABYRINTHINE STRUCTURE

[75] Inventor: Hideaki Haigo, Nagoya, Japan

[73] Assignee: Brother Kogyo Kabushiki Kaisha, Nagoya, Japan

[21] Appl. No.: 08/760,599

[22] Filed: Dec. 4, 1996

[30] Foreign Application Priority Data

Dec. 5, 1995 [JP] Japan ..... 7-344918
Feb. 1, 1996 [JP] Japan ..... 8-016429

[51] Int. Cl.[6] ..... B41J 2/175

[52] U.S. Cl. ..... 347/86

[58] Field of Search ..... 347/84, 85, 86, 347/87

[56] References Cited

U.S. PATENT DOCUMENTS 5,629,728 5/1997 Karita et al. ..... 347/87
5,790,158 8/1998 Shinada et al. ..... 347/86

FOREIGN PATENT DOCUMENTS 32603 2/1995 Japan .

*Primary Examiner*—N. Le
*Assistant Examiner*—Anh T. N. Vo
*Attorney, Agent, or Firm*—Oliff & Berridge, PLC

[57] ABSTRACT

An ink cartridge for use in an ink jet printer includes a cartridge body and a lid. The cartridge body has an ink reservoir storing ink therein, arid is in a box-shape having one open surface. The lid is fixedly secured to the open surface of the cartridge body to hermetically seal the opern surface. The cartridge body is provided with a secondary housing formed with a hole open to atmosphere. In the secondary housing, inner walls are formed which define a communication channel of a labyrinthine structure for making a fluid communication between the ink reservoir and an outside atmosphere through the hole. The provision of such a communication channel smoothens the supply of ink to a print head but the labyrinthine structure prevents the ink evaporation.

19 Claims, 10 Drawing Sheets

INK CARTRIDGE HAVING AN ATMOSPHERE COMMUNICATING CHANNEL OF LABYRINTHINE STRUCTURE

BACKGROUND OF THE INVENTION

1. Field of the Invention

The present invention relate to an ink cartridge for use in an ink jet painter, and more particularly to an ink cartridge provided with an ink reervoir filled with an ink permeated material, such as ink containing porous material.

2. Description of the Related Art

Typically, ink jet printers are provided with a recording unit, a recording medium feeding unit for feeding a recording medium, and a carriage unit for reciprocally moving the recording unit in the widthwise dimension of the recording medium. The recording unit includes an ink jet type print head and an ink cartridge detachably mounted on the recording unit for supplying ink to the print head. The recording medium feeding unit includes a platen roller for feeding the recording medium past the recording unit in a direction perpendicular to the direction in which the recording unit reciprocally moves. The carriage unit includes a carriage for mounting ttie recording unit thereon. The carriage slidably movably supported on a guide rod extending in parallel with the axial direction of the platen roller. The carriage is reciprocally moved back and fortt along the guide rod by a belt stretched between a drive pulley driven by a motor and a driver pulley.

As disclosed in Japanese Laid-Open Patent Publication (Kokai) No. HEI-7-32603, the ink cartridge is formed with not only an ink introduction port for supplying ink from an ink reservoir to the print head but also a communication hole open to atmosphere, so that the internal space of the ink cartridge is held at the atmospheric pressure and thus ink supply from the ink reservoir to the print head can be smoothly performed. When such an atmosphere communication hole is provided, it is required that air be prevented from freely moving through the communication hole in order to prevent ink evaporation. To this end, it has been a general practice to connect the ink reservoir and atmosphere with a communication path of a labyrinthine structure.

One such example is shown in FIG. 1 wherein a groove c of a crank or labyrinthine structure is formed on the top surface of a lid b attached to an ink cartridge. One end of the groove c is in communication with the internal space of the ink cartridge, i.e., ink reservoir. A seal member d is bonded or thermally adhered to cover the groove c while exposing the other and of the groove in atmosphere, thereby bringing the ink reservoir into communication with atmosphere.

Another example is shown in FIG. 2. A large-diameter attachment hole f is formed in the cartridge body e and an attachment member g is fitted into the attachment hole f The attachment member g is formed with apertures. The attachment hole r and the attachment member g in combination provide an atmosphere communication channel of labyrinthine structure. Hence, the internal space of the ink cartridge is drought into communication with atmosphere.

However, the conventional structures as described above increase the number of components required for forming the atmosphere communication path, such as seal member d or attachment member g. This increases the number of manufacturing steps and manufacturing cost.

SUMMARY OF THE INVENTION

The present invention has been made in view of the foregoing, and accordingly it Is an object of the present invention to provide an ink cartridge for an ink jet printer wherein an ink reservoir can be in communication with an atmosphere without increasing the number of components.

To achieve the above and other objects, there is provided an ink cartridge including a cartridge body having an ink reservoir storing ink therein, the cartridge body being in a box-shape having one open surface, and a lid fixedly secured to three open surface of the cartridge body to hermetically seal the opern surface. Selected one of the cartridge body and the lid is integrally formed with walls defining a communication channel for making a fluid communication between the ink reservoir and an outside atmosphere. The walls are fixedly secured to non-selected one of the cartridge body and the lid. The non-selected one of the cartridge body and the lid is integrally formed with a rib which extends into the communication channel when the lid and the cartridge body are fixedly secured. The communication channel thus forced has a labyrinthine structure.

The ink cartridge has one end formed with an ink supply port for supplying ink to a print head of an ink jet printer and another end formed with a secondary housing in which the walls are integrally formed. The ink reservoir and the secondary housing are integrally formed.

The secondary housing includes a partition wall for is separating the secondary housing from the ink reservoir, and the partition wall and the lid form a space connected to the communication channel. The secondary housing is formed with a through-hole open to the outside atmosphere, and the communication channel is connected to the through-hole.

The rib is disposed in a space between the walls. The rib is formed with tapered surface for facilitating insertion of the rib into the communication channel. The rib further defines the communication channel.

each of the walls and the lid from at least one space that constitutes a part of the communication channel.

According to another aspect or the present invention, there is provided an ink cartridge including the cartridge body and the lid as described above, wherein selected one of the cartridge body and the lid is formed with a convex portion and non-selected one of the cartridge body and the lid is formed with a concave portion so that the convex portion and the corncave portion are generally mated with each other. The convex portion and the concave portion are in contact with each other in a predetermined area and form a gap in another predetermined area. The gap is used as a part of a communication channel for making a fluid communication between the ink reservoir and an outside atmosphere.

At least one inner wall is formed in the selected one of the cartridge body and the lid. The inner wall defines another part of the communication channel.

The cartridge body has an ink supply portion at one end thereof for supplying ink to tein print head therethrough, and a secondary housing at another end thereof opposite to the one end in which the communication channel is formed.

The concave portion and the convex portion can be used for positioning the lid on the open surface of the cartridge body. The open surface of the cartridge body has a tapered inner periphery, and the lid has the cornvex portion in contact with the tapered inner periphery. The concave portion has a tapered surface in surface alignment with the tapered inner periphery of the cartridge body.

BRIEF DESCRIPTION OF THE DRAWINGS

The above and other objects, features and advantages of the present invention will become more apparent from the following description when taken in conjunction with the accompanying drawings, in which:

FIG. 6(*b*) is a vertical cross-sectional view showing the ink cartridge according to the first embodiment of the present invention;

FIG. 7(*b*) is a vertical cross-sectional view showing the atmosphere communication channel formed in the ink cartridge after the lid and the ink cartridge are fuse bonded according to the first and second embodiment of the present invention;

DETAILED DESCRIPTION OF THE PREFERRED EMBODIMENTS

Preferred embodiments of the present invention will be described while referring to the accompanying drawings. In the following description, tnre expressions "front", "rear", "right", "left", "above" and "below" are used throughout the descriptiorn to define the variouis parts when an ink jet printer is disposed in an orientation in which it is intended to be used.

Figure 1:
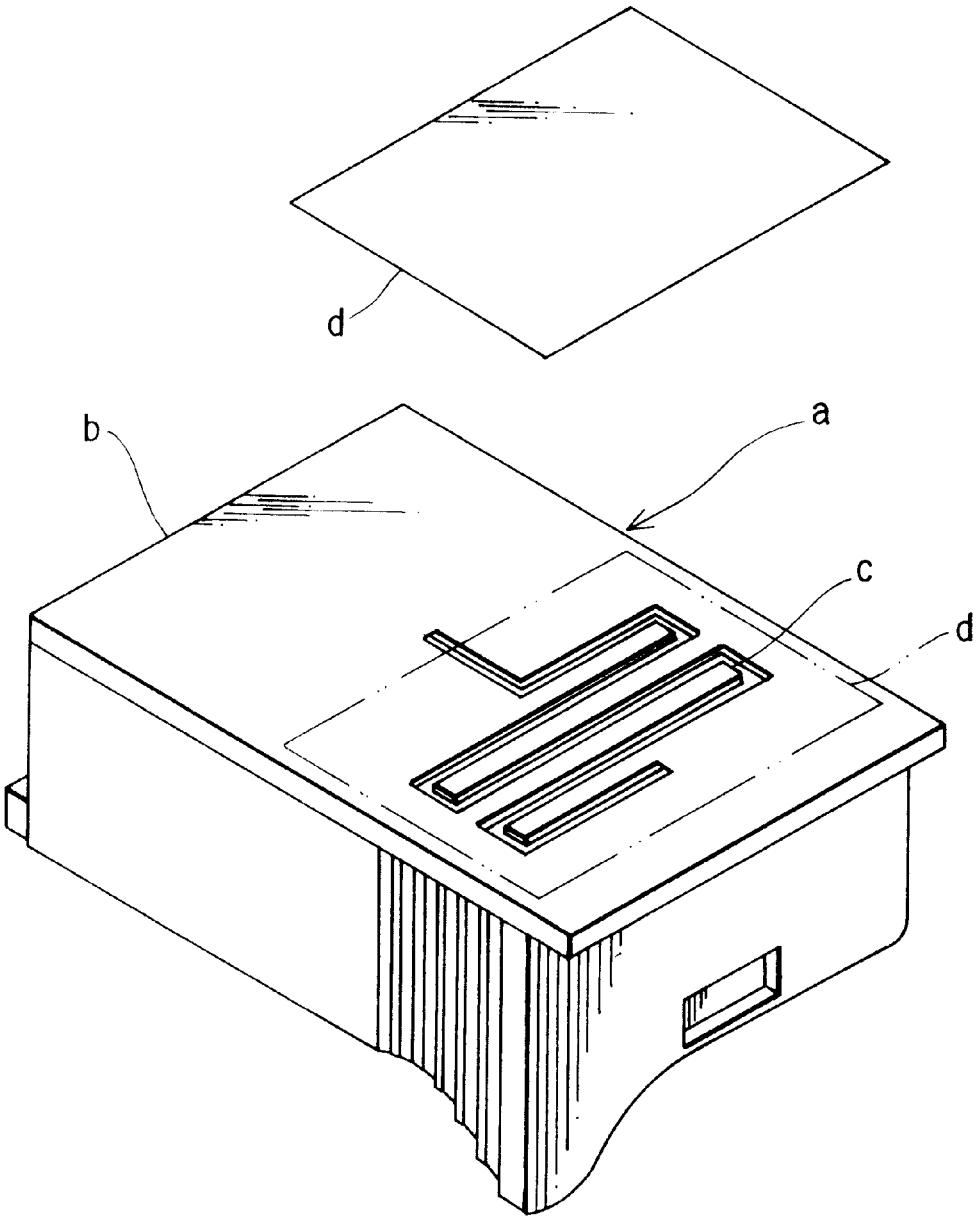
FIG. 1 PRIOR ART
FIG. 1 is a perspective view showing a conventional ink cartridge.
Figure 2:
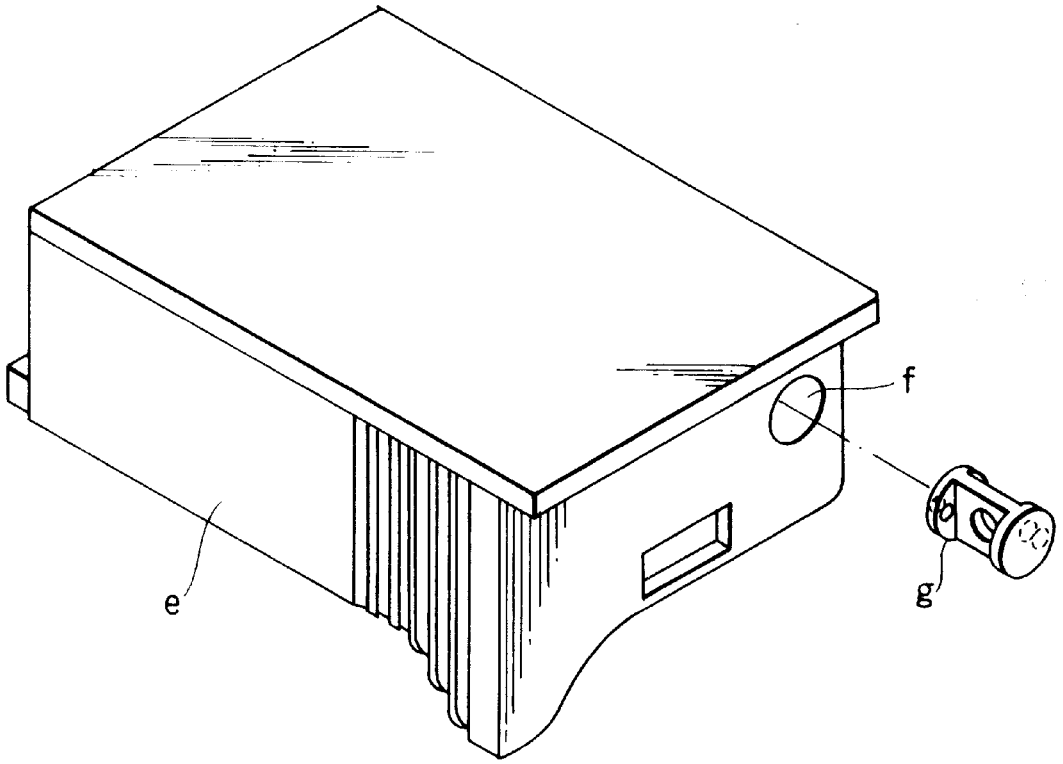
FIG. 2 PRIOR ART
FIG. 2 is a perspective view showing another conventional ink cartridge.
Figure 3:
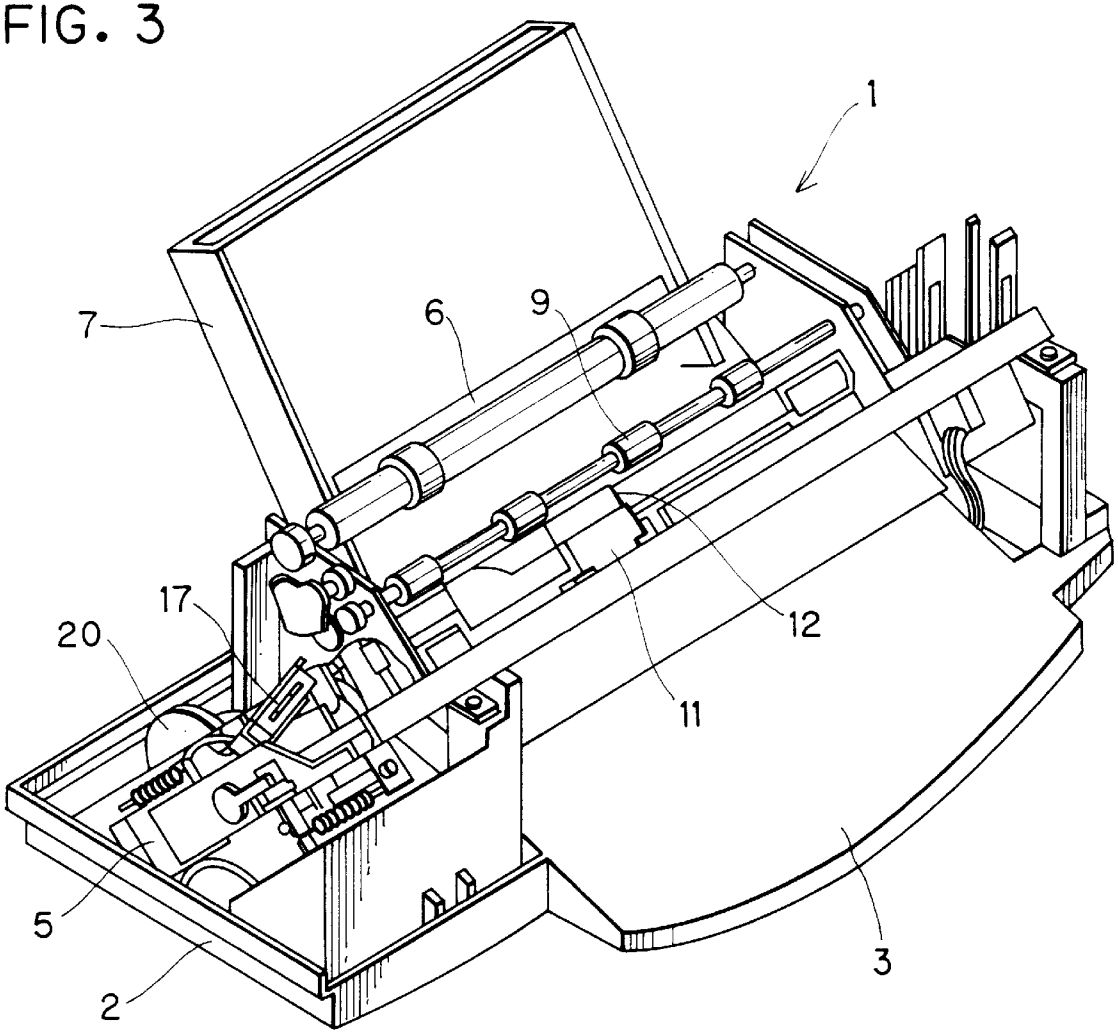
FIG. 3 is a perspective view showing an example of an ink jet printer to which the present invention is applied.
Figure 4:
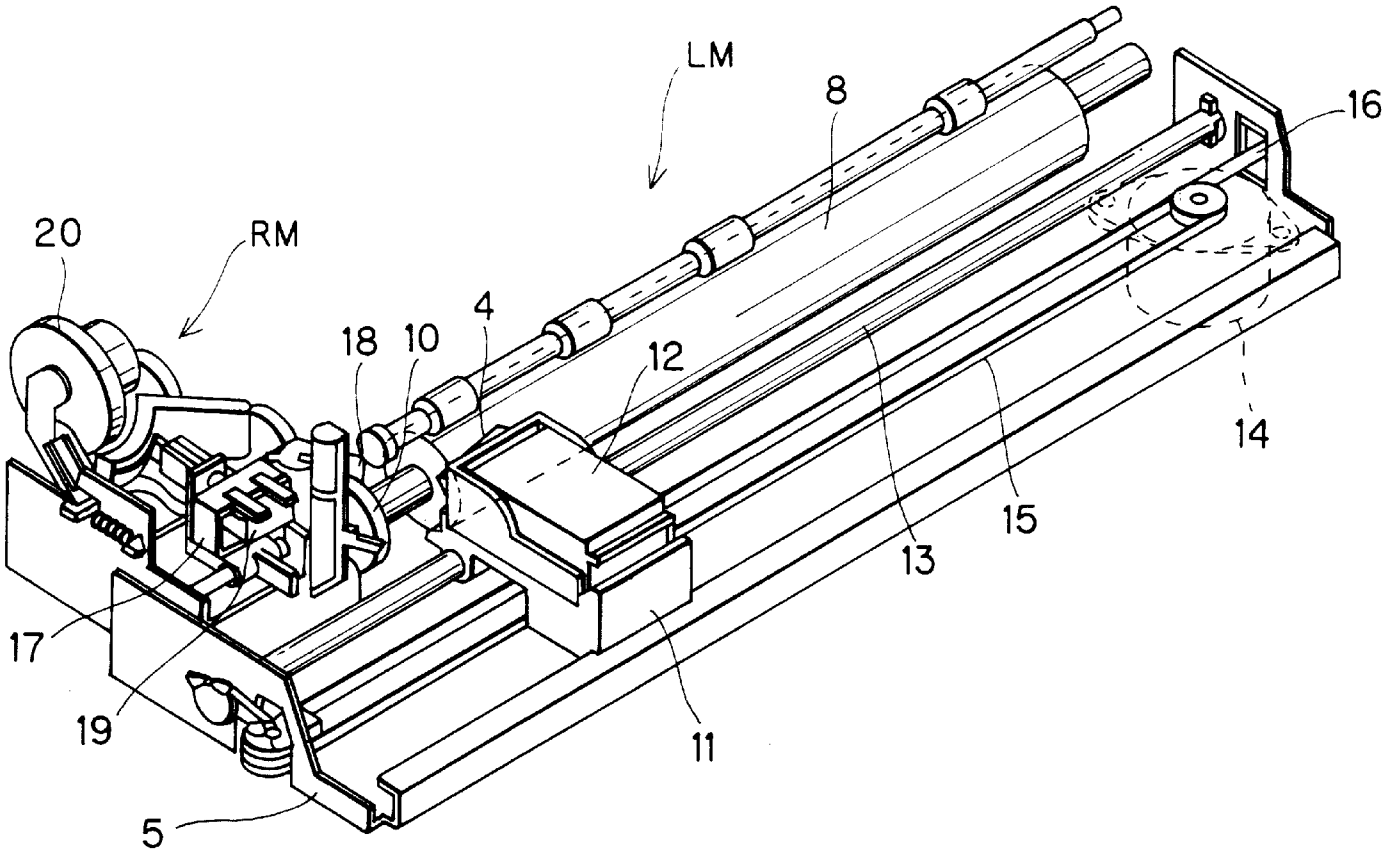
FIG. 4 is a perspective view showing an inner structure of the ink jet printer shown in FIG. 3.

Referring first to FIGS. 3 and 4, the structure of an ink jet printer will be described. The ink jet printer 1 includes a frame 2, a manual paper feed section 3 disposed in front of the frame 2, and a sub-frame 5 disposed rearwardly of the manual paper feed section 3. The sub-frame 5 houses therein an ink jet type print head 4, a recovery mechanism RM, and a paper feed mechanism LM. A paper cassette 7 is detachably provided above and rearwardly of the sub-frame 5.

A cylindrical shape platen roller 8 is rotatably disposed in the sub-frame 5. The platen roller 8 is a part of the paper feed mechanism L1 and feeds a recording paper 6 selectively supplied from the paper cassette 7 and the manual paper feed section 3 past the print head 4.

Above the platen roller 8, pressure rollers 9 are rotatably provided for urging the recording paper 6 against the platen roller 8. A platen gear 10 is provided at one end of the platen roller 8 to be integral therewith. The platen roller 8 is rotated by the platen gear 10 which in turn is rotated by a paper feed motor (not shown) The plate gear 10 also transmits a driving force to gear trains (nor shown) that feed the recording paper 6 from the paper cassette 7 to the plate roller one by one.

A carriage 11 is provided in front of the platen roller 8. A print head 4 and an ink cartridge 12 are detachably mounted on the carriage 11. The ink cartridge 12 stores ink therein and supplies ink to the print head 4. The carriage 11 is reciprocally movable along a guide rod 13 extending in parallel to the axial direction of the platen roller 8 so that the print head 4 can move along the platen roller 8.

A carriage drive motor 14 for driving the carriage 11 is disposed at the right side on the reverse surface of the sub-frame 5. The carriage drive motor 14 drives the carriage 11 via a belt 15. A stepping motor or a DC motor is used as the carriage drive motor 14. A tape-shaped position gauge 16 marked with scales thereon is disposed along the belt 15.

The recovery mechanism RM is disposed at the left side of the platen roller 8. The recovery mechanism RM is provided for recovering the print head 4 when ink ejection troubles occur. The ink ejection troubles may occur when air bubbles are generated inside the print head 4 during printing or when ink droplets are adhered to the nozzle surface. The recovery mechanism RM includes a purging device 17 for sucking ink from the print head 4, and a wiping device 18 for wiping off the ink from the nozzle surface of the print head 4.

The purging device 17 has a cap 19 adapted to cover the print head 4. In the state were the cap 19 covers the print head 4, a negative pressure produced by a pump (not shown) connected to the purging device 17 sucks ink from the print head 4 to thereby recover a good ink ejection condition. The pump connected to red purging device 17 is driven by a paper feed motor (not shown) via a pump cam gear 20.

Figure 5:
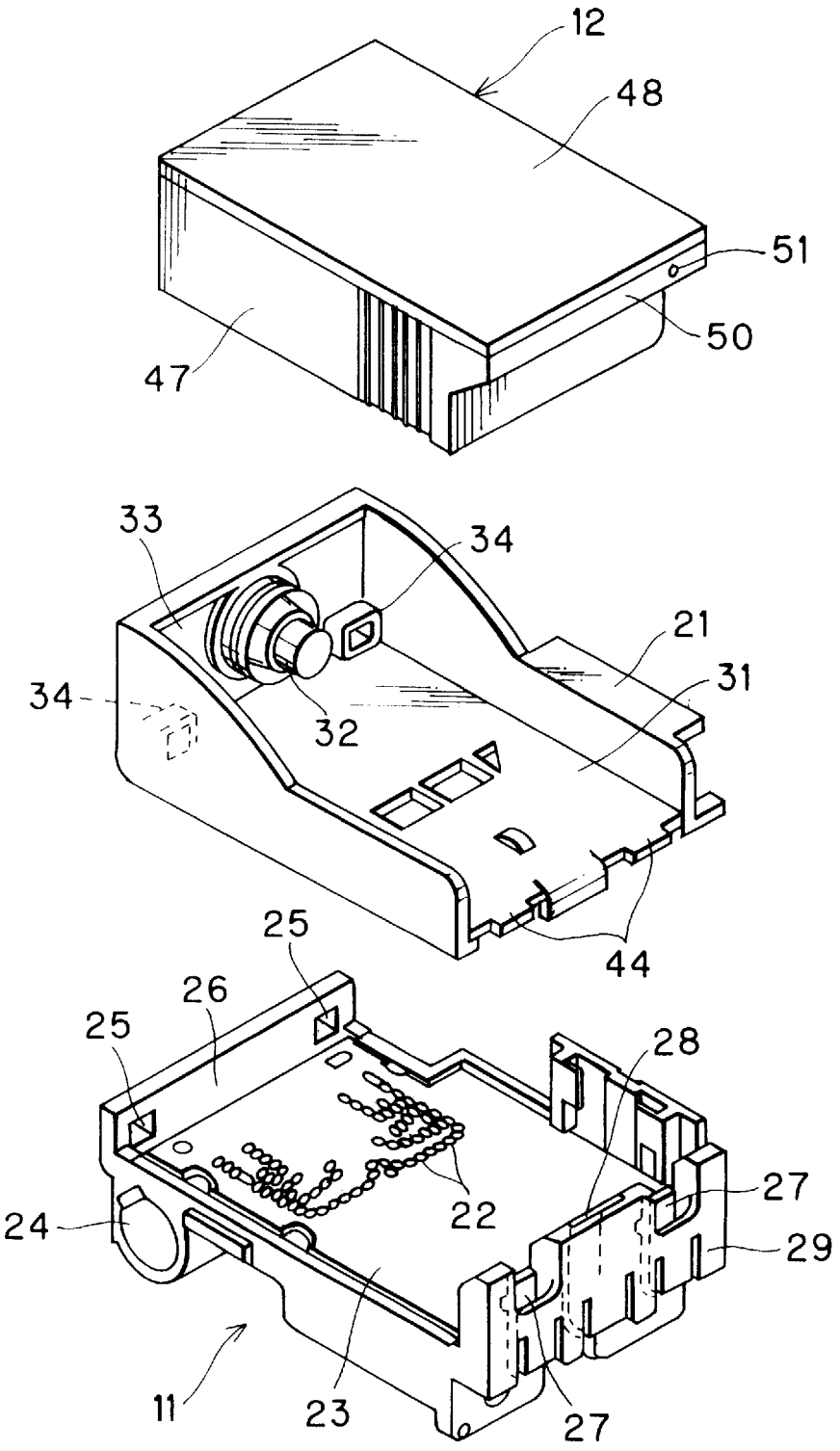
FIG. 5 is a fragmentary diagram showing an ink cartridge, a head unit and a carriage.

As shown in FIG. 5, an ink cartridge 12 is loaded on a head unit 21 which in tarn is mounted on the carriage 11. The carriage 11 has a substrate 22 formed with a number of electrical contacts 22. One side lower portion or the carriage 11 is formed with a hole 24 into which the guide rod 13 is inserted. An upstanding wall 26 formed with head unit positioning holes 25 is formed at one end on the upper surface of the carriage 11. Another upstanding wall 27 is formed at the other end on the upper surface of the carriage 11, in which formed are tread unit attachment pawls 27 and an ink cartridge attachment pawl 28.

The head unit 21 is formed with a wall 33 at one end thereof. An ink introduction bort 32 is integrally formed to the wall 33. Ink cartridge positioning holes 34 are formed in the wall 33 in positions at both sides of the ink introduction port 32. An ink head 4 is attached to the outer surface of the wall 33 to be connected to the ink introduction port 32. The ink head 4 includes an actuator (not shown) for ejecting ink droplets from nozzles formed in a nozzle plate.

Figure 6A:
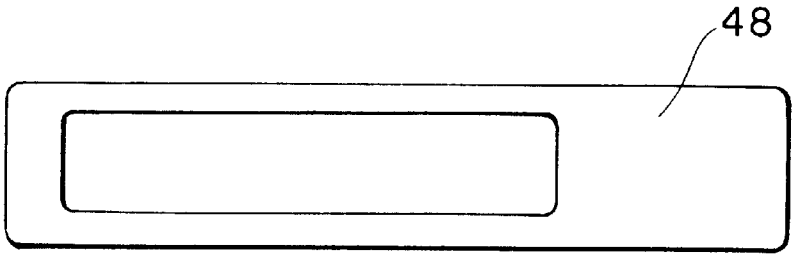
FIG. 6(*a*) is a plan view showing the ink cartridge according to a first embodiment of the present invention.
Figure 6B:
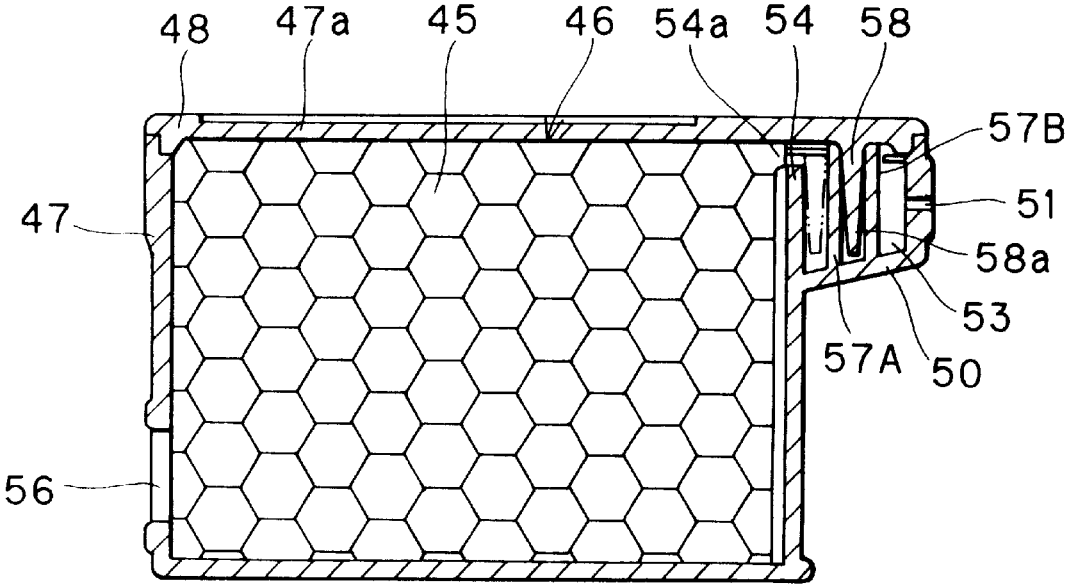

An ink cartridge according to a first embodiment of the present invention will be described while referring to FIG. 6(*a*)–6(*b*), 7(*a*)–7(*b*), and 8 through 10. As shown in FIGS. 6(*a*) and 6(*b*), the ink cartridge 12 is composed of a box-shaped cartridge 47 with an open surface at the top thereof, and a lid 48 to be fixedly secured to the cartridge 47 to cover the top open surface thereof by an adhesive or fuse bonding using ultrasonic wave. The cartridge 47 contains an ink reservoir 46 tilled with an ink permeated material 45, such as porous material.

An ink supply port 56 is formed at the front lower portion of the cartridge 47, into which the ink introduction port 32 is inserted. A protruding portion 50 is formed in the rear upper portion of the cartridge 47. A through-hole 51 is formed in the outer wall of the protruding portion 50. The internal space of the protruding portion 50 is partitioned by a partition wall 54 and inner walls 57A and 57B. The partition wall 54 that is a part of the side wall of the cartridge 47 is provided between the ink reservoir 46 and the internal space of the protruding portion 50. A horizontally elongated slit 54*a* is formed between the top face of the partition wall 54 and the reverse surface of the lid 48, which brings the ink reservoir 46 into fluid communication with the internal apace of the protruding portion 50. However, due to the narrow slit 54*a* formed between the ink reservoir 46 and the protruding portion 50, air flow therebetween does not occur smoothly. A communication channel is formed in the protruding portion 501 and is defined by the partition wall 54 and inner walls 57A and 57B. The communication channel 53 formed in the internal space of the protruding portion 50 is connected to the ink reservoir 46 through the slit 54*a* and also to an outside atmosphere through the through-hole 51.

The inner walls 57A and 57B have lower ends integrally formed to the bottom surface of the outer wall and two side edges integrally formed to the right and left side walls of the cartridge 47. The lid 48 is formed with a rib 58 which is inserted between a space between the two inner walls 57A and 57B. The rib 58 is formed with tapered surfaces 58*a* so that insertion of the rib 58 into the space between the two inner walls 57A and 5B can be accomplished easily. The lowermost surface of the rib 58 does not contact the bottom surface of the protruding portion 50 when the rib 58 is fully inserted into the space therebetween.

Figure 7A:
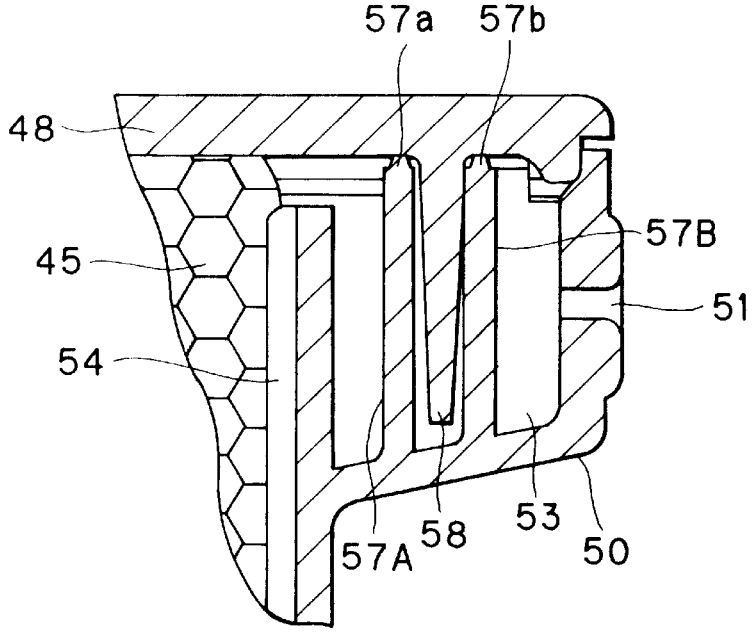
FIG. 7(*a*) is a vertical cross-sectional view showing an atmosphere communication channel formed in the ink cartridge before a lid and the ink cartridge are fuse bonded according to the first and second embodiment of the present invention.
Figure 7B:
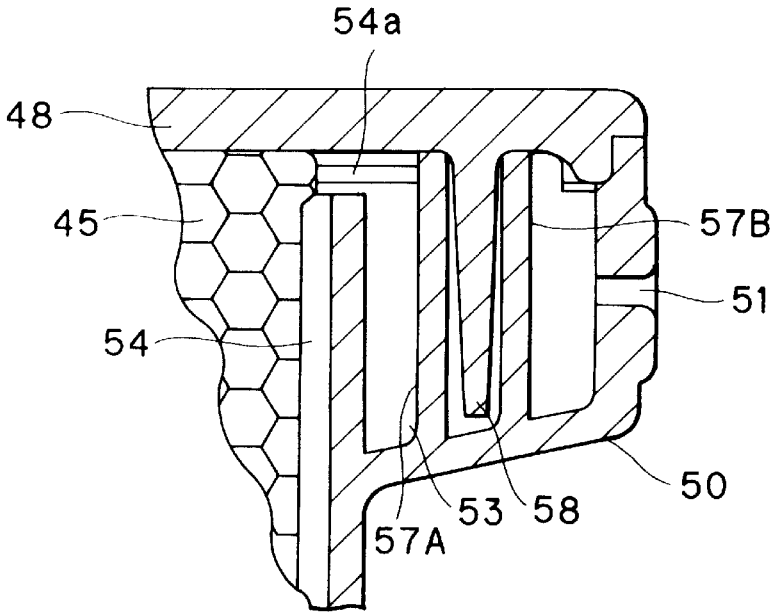

The cartridge 47 and the lid 48 are fixedly secured by fuse bonding using ultrasonic wave. As shown in FIG. 7(*a*), the top surfaces of the inner walls 57A and 57E are formed with convex portions 57*a* and 57*b* having a semi-circular cross-section, respectively. As shown in FIG. 7(*b*), the convex portions 57*a* and 57*b* are melted when heated and bonded to the reverse surface of the lid 48.

Figure 8:
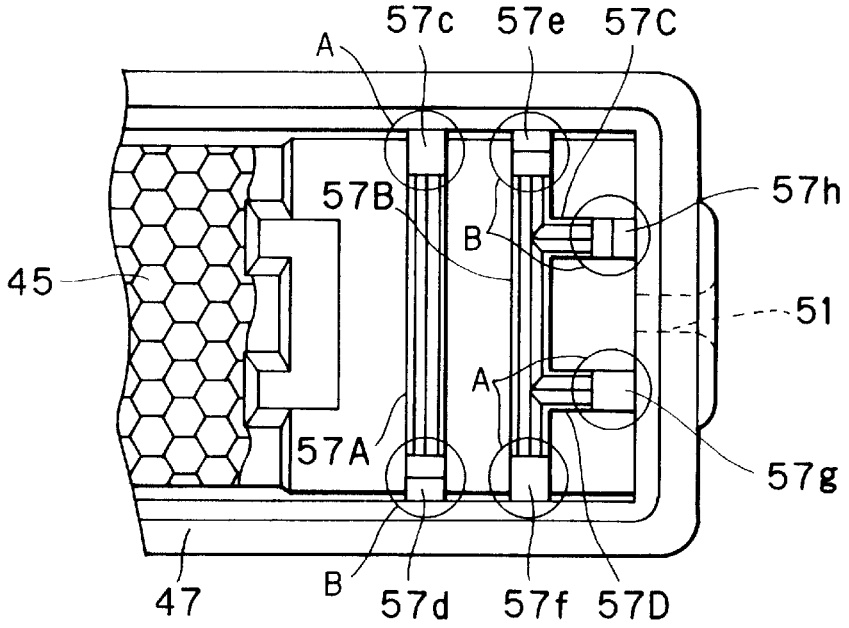
FIG. 8 is a plan view showing a protruding portion formed in a cartridge body.
Figure 9:
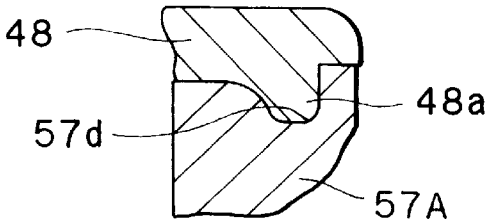
FIG. 9 is a vertical cross-sectional view showing "A" portion shown in FIG. 8 after the lid and the ink cartridge are fused bonded.
Figure 10:
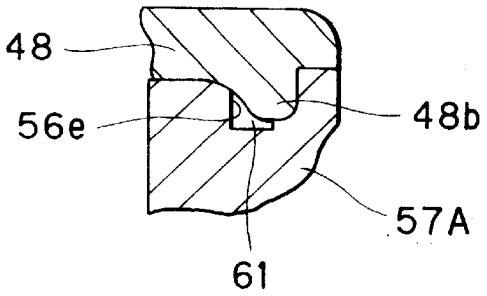
FIG. 10 is a vertical cross-sectional view showing "B" portion shown in FIG. 8 after the lid and the ink cartridge are fused bonded.

As shown in FIGS. 8 through 10, the inner wall 57A has two sides formed with concave portions 57*c* and 57*d*. The lid 48 is formed with corresponding two convex portions 48*a*, 48*b* which are fitted into the concave portions 57*c* and 57*d*, respectively.

The inner wall 57B is composed of a first segmental portion extending substantially in parallel with the other inner wall 57A, and second and third segmental portions 57C and 57D bridged between the first segmental portion and the outer wall so as to locate the through-hole 51 between these two segmental portions 57C and 57D. Also, concave portions 57*e* through 57*h* are formed in the two ends of the first segmental portion and in the rearmost portions of the second and third segmental portions 57C and 57D so that the convex portions formed on the reverse surface of the lid 48 are mated. When the lid 48 is fitted Lo the cartridge 47, a space is formed in one side (57*e*) of the First segmental portion. In the other side (57*f*) of the first segmental portion 57, no space is formed. Similarly, space is formed in the concave portion 57*f* whereas no space is formed in the concave portion 57*g*. In FIG. 8, the portions encircled by "A" indicates formation of the space and the portions encircled by "B" indicates of formation of the space. The through-hole 51 and the ink reservoir are thus connected with a communication channel 53 with a labyrinthine structure.

Modification may be made with respect to the formation of the spaces in the portions "A" and "B" so that the portions "A" have a relatively large space whereas the portions "B" have a relatively small space. By the combination of the small volume spaces and the large volume spaces, a more complicated communication channel with a labyrinthine structure can be formed.

As described, the communication channel 53 connecting the internal space of the ink reservoir 46 to the outside atmosphere is formed by the partition wall 54 and inner walls 57A and 572 that are integrally formed in the protruding portion 50, therefore, the communication channel 53 can be formed when molding the cartridge 47 with a resin using a metal mold. Molding of the lid 48 can also be performed easily. Further, the communication channel 53 can be formed by simply securing the lid 48 to the top surfaces of the partition wall 54 and the Turner walls 57A and 57B. Therefore, no special components are required to form the communication, channel 53.

Because the rib 58 is integrally formed to the lid 48 and the position in which the rib 58 is inserted is determined, the lid 48 will not to attached to the cartridge 47 in the wrong direction. Further, due to the tapered surfaces 58*a* forced in the rib 58, the lid 48 is brought into smooth mating with the cartridge 47 and both are fitted to each other accurately. Therefore, bonding of the lid 48 and the cartridge 47 can be attained with high accuracy. In addition, the lid 48 can be positioned accurately on the cartridge 47, so that the lid 48 will not be slipped off from the cartridge 47 during conveyance with a conveyor belt.

The communication channel 53 is formed inside the protruding portion 50 that is located opposite the ink supply port 5 to which the wra introduction port 32 is connected, and the ink introduction port 32 and the communication channel 53 are located in opposition with respect to the ink reservoir 46. Therefore, when the ink is supplied from the ink introduction port 32 to the print head 4, air is smoothly introduced into the ink reservoir 46 through the through-hole 51 and the Communication channel 32.

Because the partition wall 54 and inner walls 57A and 57B are formed inside the protruding portion 50 that is separated from the ink reservoir 46, the shape of the communication channel 53 can be designed flexibly without affecting the shape of the ink reservoir 46. That is, the shape or distribution of the communication channel can be freely determined in terms of preventing ink evaporation.

The walls defining the communication channel 53 and also the rib 58 inserted into the communication channel 53 can, prevent air from freely flowing between the ink reservoir 46 and the outside atmosphere and thus prevent evaporation of ink. Furthermore, ink leakage out of the ink cartridge 1 which may occur due to changes in atmospheric pressure, temperature, can be effectively prevented. The space 61 (see FIG. 10) formed in "A" portions indicated in FIG. 8 serves as neck portions in the communication channel 53. Those neck portions also unsmoothen the air flow between the ink reservoir 46 and the outside atmosphere In the first embodiment described above, the partition wall 54 and the inner walls 57A and 57B are formed integrally with the cartridge 47. However, the partition wall and the inner walls may be integrally formed in the lid 48 by resin molding. In this case, the communication channel is formed by fixing the lower end portions of the partition wall and the inner walls to the bottom surface of the cartridge body 47. The rib extending into the communication channel is formed in the cartridge body 47. Further, the through-hole 51 open to atmosphere may be formed in the lid. Only a single rib 58 extends into the communication channel 53 from the lid 48, a plurality of ribs may be formed in the lid 48 and extend into the communication channel 53 as shown by a dotted line in FIG. 6(*b*). In the first embodiment, although the communication channel 53 is formed in the full inner space of the protruding portion 50, it can be formed in a vertically limited space of the protruding portion 50 so that the air flow can be limited more strictly.

Figure 11:
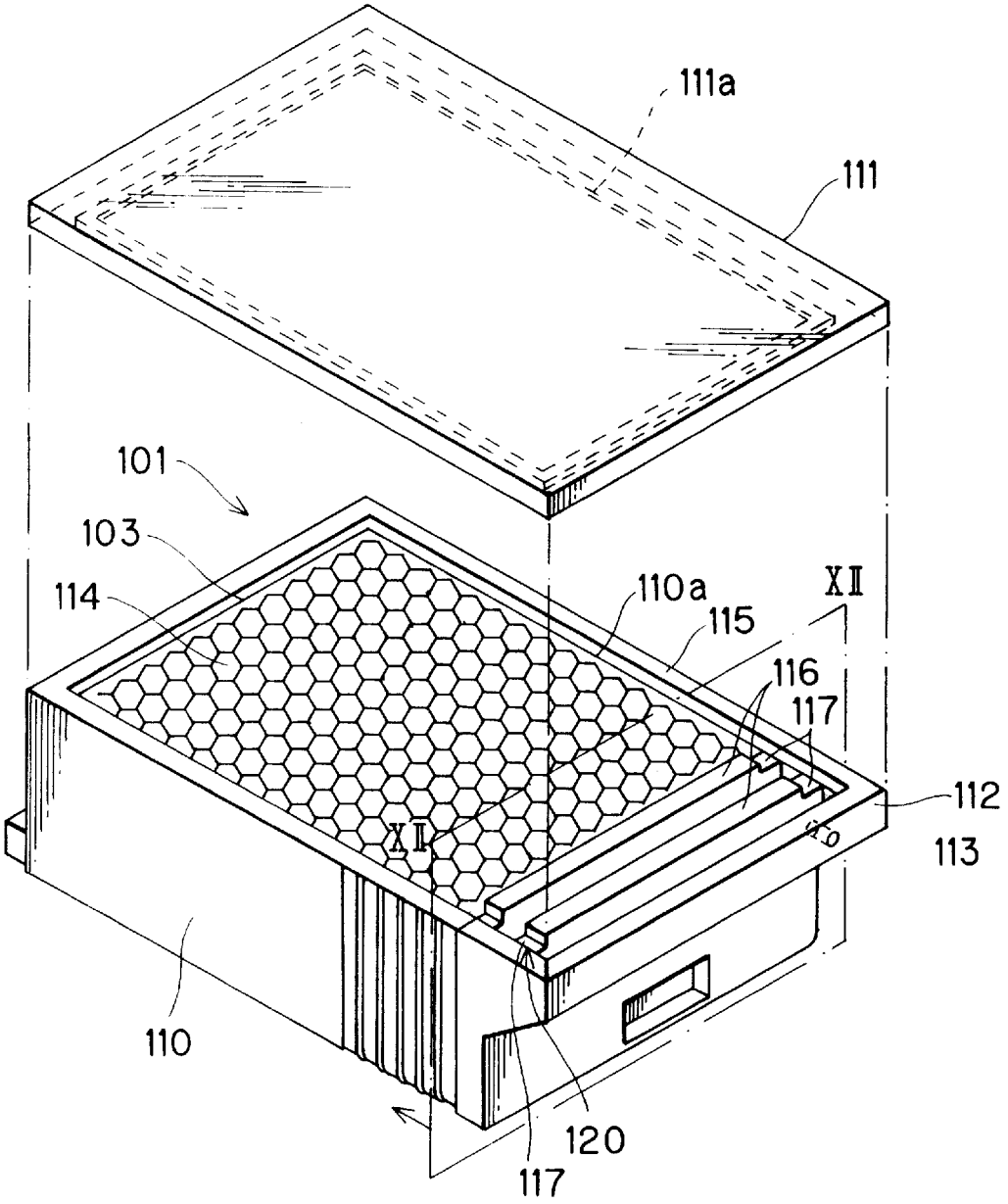
FIG. 11 is a fragmentary diagram showing an ink cartridge according to a second embodiment of the present invention.
Figure 12:
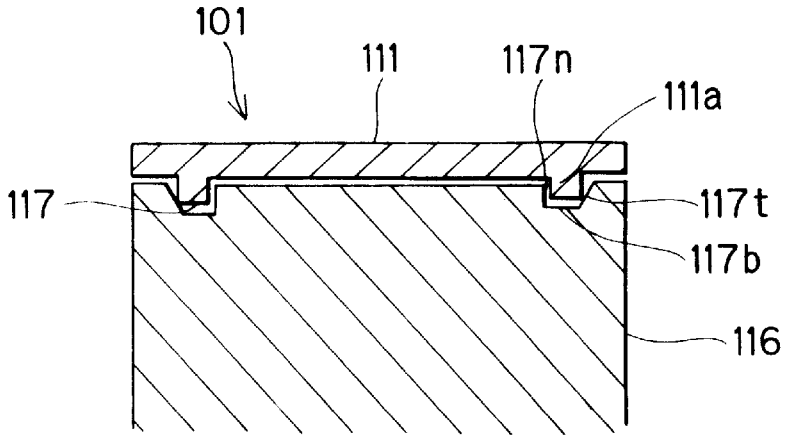
FIG. 12 is a cross-sectional view showing an ink cartridge body and a lid fitted to each other for subsequent fuse bonding.
Figure 13:
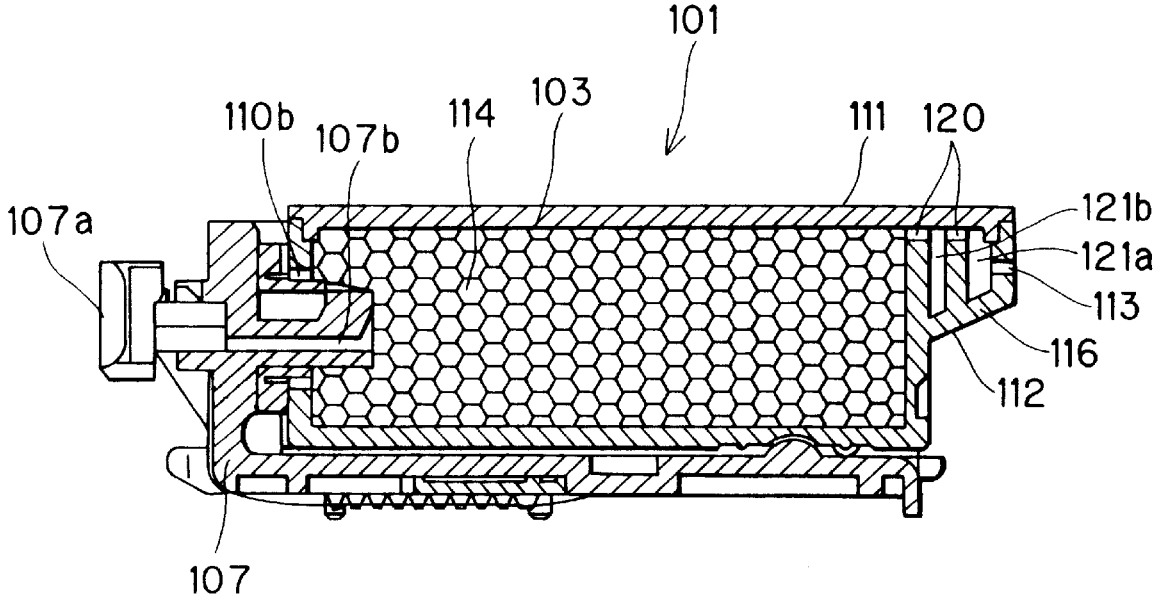
FIG. 13 is a cross-sectional view showing the ink cartridge loaded into a print heat unit.

A second embodiment of the present invention will be described while referring to FIGS. 11 through 13. FIG. 11 is a fragmentary diagram showing the ink cartridge. FIG. 12 is a cross-sectional view cut along the line XII—XII indicated in FIG. 11 showing that an ink cartridge body and a lid are fitted to each other for subsequent fuse bonding. FIG. 13 is a cross-sectional view showing that the ink cartridge 1 is loaded on the print head unit 7.

As shown in FIGS. 11 and 12, the ink cartridge 101 is composed or a cartridge body 110 provided with an ink reservoir 103, and a lid 111 for fixedly covering the open surface of the ink cartridge body 110. As shown in FIGS. 11 and 13, the cartridge body 110 has one end formed with a protruding portion 112 and an opposite end formed with an ink introduction port 110*b*. The protruding portion 112 has an outer wall formed with a through-hole 113 open to atmosphere. When the ink cartridge 101 is mounted on a head unit 107, the ink supply port 110*b* of the ink cartridge 101 is fitted to the ink introduction port 107*b* protruding toward the interior of the print head unit 107. The ink reservoir 103 contains an ink permeated material 114 therein. The inner peripheral edges or the open surface of the cartridge body 110 are formed with a tapered surface 110*a*. the reverse surface of the lid 111 is formed with a convex portion 111*a* slightly inwardly of the outer periphery of the lid 111. When the lid 111 is placed over the open surface of the cartridge body 110, the cuter edge of the convex portion 111*a* formed on the lid 111 is brought into line contact with the tapered surface 110*a* of the cartridge body Two inner walls 116 are provided internally of the protruding portion 112 so as to be in parallel with each other and in perpendicular to the side wall 115 of the cartridge body 110. Each of the inner walls 116 has two concave portions 117 at both ends of the top surface thereof. As shown in FIGS. 11 and 12, each corcave portion 117 is defined by a tapered wall 117*t* which is in surface alignment with the tapered surface 110*a* of the cartridge body 110, an upstanding wall 117*n* confronting the tapered surface 117*t*, and a bottom wall 117*b* extending between the tapered surface 117*t* and the upstanding wall 117*n*. The outer edge portion of the convex portion 111*a* of the lid 111 is in line contact with the tapered wall 117*t* of the cconcave portion 117. The lid 111 and the cartridge body 110 are fixedly bonded together by hermetically sealing the contacting portions between the lid 11 and the concave portions 117 while using supersonic wave or the like.

The dimension of the respective concave portions 117 formed in the two inner walls 116 and the dimension of the convex portion 111*a* formed in the lid 111 are determined so that a spacing 120 (see FIG. 13) is formed in each of the convex portions 117 when the cartridge body 110 and the lid 111 are bonded together. This spacing 120 serves as a communication channel to be described later. The shape and distension or the spacing 120 can be set as desired by adjusting the height of the convex portion 111*a* of the lid 111 and/or the depth of the concave portions 117 formed in the cartridge body 110. The remaining portions on the top surfaces of the inner walls 116 are in intimate contact with the inner flat surface of the lid 111 and hermetically bonded together.

FIG. 13 shows that the ink cartridge 101 is loaded on the print head unit 107. The ink reservoir 103 of the ink cartridge 101 is in fluid communication with the through-hole 113 through the communication channel 120. Therefore, the ink reservoir 103 is open to atmosphere through the communication channel 120. Also, the ink reservoir 103 is in fluid communication with the print head 107*a* through the inks introduction port 107*b* formed in the head unit 107. The print head 107*a* ejects ink droplets toward a recording medium placed in front of the print head 107*a* using ink supplied from the ink reservoir 103 through the ink introduction port 107*b*. The print head 107*a* as used in this embodiment is of an ink jet type in which the ink droplet is ejected in accordance with displacement of the piezoelectric element.

As described, the cartridge body 110 and the lid 111 are fitted to each other and thee the contacting portions between the tapered surface 111*a* of the cartridge body 110 and the convex. portion 111*a* of the lid 111 are fuse bonded. Therefore, both members are hermetically fixedly secured to each other along the entire periphery. When the cartridge boy 110 and the lid 111 are fixedly secured in this manner, the spacing 120 serving as the communication channel is formed by the inner walls 116 of the cartridge body 110. Because the communication channel is formed in this way, no special step is necessary in forming the communication channel. Through the communication channels 120, the ink reservoir 103, the space 121*b* defined by the two inner walls 116, and the space 121*a* defined by the outer wall 115 and the outwardly positioned inner wall 116 are in fluid communication with one another. Consequently, the ink reservoir 103 is open to the atmosphere through the ink channel thus defined. In this manner, a couple of inner walls and the outer wall form the communication channel of a labyrinthine structure. Therefore, the atmospheric pressure in the ink reservoir 103 is held substantially the same as in the outer atmospheric pressure, so that the ink supply to the print head 107*a* can be effected smoothly. Further, because the cartridge body 110 and the lid 111 are fixedly secured to each other at high accuracy and there is no unwanted spacing between the two, ink. evaporation can be greatly reduced.

While exemplary embodiments of this invention have been described in detail, those skilled in the art will recognize that there are many possible modifications and variations which may be made in these exemplary embodiments while yet retaining many of the novel features and advantages of the invention. For example, modifications may be made with respect to the number of the inner walls, the shape and position of the inner walls, the position of the through-hole led to the outer atmosphere, a method of fixedly securing the cartridge body and the lid, and also the formation of the tapered surfaces in the outer wall of the cartridge body.

What is claimed is:

1. An ink cartridge for an ink jet printer having a print head, comprising:

a cartridge body having an ink reservoir storing ink therein, said cartridge body being in a box-shape having one open surface; and a lid fixedly secured to the open surface of said cartridge body to seal the open surface;

wherein one of said cartridge body and said lid has a plurality of inner walls, and a remaining one of said cartridge body and said lid has at least one rib extending into a space between two adjacent walls of said plurality of inner walls, said plurality of inner walls and said at least one rib define a communication channel for providing fluid communication between the ink reservoir and an outside atmosphere, said inner walls being fixedly secured to the remaining one of said cartridge body and said lid.

2. The ink cartridge according to claim 1, wherein said communication channel has a labyrinthine structure.

3. The ink cartridge according to claim 1, wherein said ink cartridge has one end formed with an ink supply port for supplying ink to the print head of the ink jet printer and another end formed with a housing in which said walls are integrally formed.

4. The ink cartridge according to claim 3, wherein said ink reservoir and said housing are integrally formed.

5. The ink cartridge according to claim 4, wherein said housing includes a partition wall for separating said housing from said ink reservoir, said partition wall and said lid forming a space connected so the communication channel.

6. The ink cartridge according to claim 5, wherein said housing is formed with a through-hole open to the outside atmosphere.

7. The ink cartridge according to claim 1, wherein said rib is formed with tapered surface for facilitating insertion of said rib into the communication channel.

8. The ink cartridge according to claim 7, wherein said tapered surface further defines the communication channel.

9. The ink cartridge according to claim 1, wherein each of said walls and said lid form at least one space that constitutes a portion of the communication channel.

10. An ink cartridge for an ink jet printer having a print head, comprising;

a cartridge body having an outer wall and an ink reservoir storing ink therein, said cartridge body being in a box-shape having one open surface; and a lid fixedly secured to the open surface of said cartridge body to seal the open surface, wherein one of said cartridge body and said lid is formed with a convex portion and a remaining one of said cartridge body and said lid is formed with a concave portion so that said convex portion and said concave portion are generally mated with each other, said convex portion and said concave portion being in contact with each other in a predetermined area and forming a gap in another predetermined area, said gap being used as a portion of a communication channel for making a fluid communication between the ink reservoir and an outside atmosphere.

11. The ink cartridge according to claim 10, wherein at least one inner wall is formed on the one of said cartridge body and said lid, said at least one inner wall defining another portion of the communication channel.

12. The ink cartridge according to claim 10, wherein said cartridge body has an ink supply portion at one end thereof for supplying ink to the print head therethrough, and a housing at another end thereof opposite to said one end in which the communication channel is formed.

13. The ink cartridge according to claim 12, wherein said housing is formed with a through-hole open to the outside atmosphere, said communication channel being connected to said through-hole.

14. The ink cartridge according to claim 12, wherein said communication channel has a lahyrinthine structure.

15. The ink cartridge according to claim 10, wherein said concave portion and said convex portion are configured for positioning said lid on the open surface of said cartridge body.

16. The ink cartridge according to claim 10, wherein said open surface of said cartridge body has a tapered inner periphery, and said lid has the convex portion in contact with the tapered inner periphery.

17. The ink cartridge according to claim 16, wherein said concave portion has a tapered surface in surface alignment with the tapered inner periphery of said cartridge body.

18. An ink cartridge for an ink jet printer having a print head, comprising:

a cartridge body having an ink reservoir storing ink therein, said cartridge body being in a box-shape having one open surface and a protruding portion provided on one side of said cartridge body, a through-hole being formed in said protruding portion and communicating with an outside atmosphere; and a lid fixedly secured to the open surface of said cartridge body to seal the open surface;

wherein one of said cartridge body and said lid has a plurality of walls located in said protruded portion, and a remaining one of said cartridge body and said lid has at least one rib extending into a space between two adjacent walls of said plurality of walls, said plurality of walls and said at least one rib defining a communication channel in said protruding portion for providing fluid communication between the ink reservoir and the outside atmosphere through said through-hole, said walls being fixedly secured to the remaining one of said cartridge body and said lid.

19. An ink cartridge for an ink jet printer having a print head, comprising:

a cartridge body having an outer wall and an ink reservoir storing ink therein, said cartridge body being in a box-shape having an open surface and a protruding portion provided on one side of the cartridge body, a through-hole being formed in said protruding portion and communicating with an outside atmosphere; and a lid fixedly secured to the open surface of said cartridge body to seal the open surface, wherein one of said cartridge body and said lid is formed with a convex portion and a remaining one of said cartridge body and said lid is formed with a concave portion so that said convex portion and said concave portion are generally mated with each other, said convex portion and said concave portion being in contact with each other within said protruding portion and forming a gap used as a portion of a communication channel for providing fluid communication between the ink reservoir and the outside atmosphere through the through-hole.

* * * * *